US011352850B2

(12) United States Patent
Singh et al.

(10) Patent No.: US 11,352,850 B2
(45) Date of Patent: Jun. 7, 2022

(54) CEMENT AS A BATTERY FOR DETECTION DOWNHOLE

(71) Applicant: HALLIBURTON ENERGY SERVICES, INC., Houston, TX (US)

(72) Inventors: John Paul Bir Singh, Houston, TX (US); John L. Maida, Houston, TX (US); Mikko Jaaskelainen, Houston, TX (US); Krishna Babu Yerubandi, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/030,179

(22) Filed: Sep. 23, 2020

(65) Prior Publication Data

US 2021/0238994 A1 Aug. 5, 2021

Related U.S. Application Data

(60) Provisional application No. 62/969,020, filed on Feb. 1, 2020.

(51) Int. Cl.
*E21B 33/16* (2006.01)
*E21B 47/135* (2012.01)
*E21B 47/005* (2012.01)

(52) U.S. Cl.
CPC ..... *E21B 33/16* (2013.01); *E21B 47/005* (2020.05); *E21B 47/135* (2020.05)

(58) Field of Classification Search
CPC ..... E21B 33/14–167; E21B 47/005
See application file for complete search history.

(56) References Cited

U.S. PATENT DOCUMENTS 6,634,425 B2 10/2003 King et al.
7,077,200 B1 * 7/2006 Adnan ..... E21B 47/135 166/250.01
8,436,743 B2 5/2013 Auzerais et al.
2008/0023328 A1 1/2008 Jiang et al.
2011/0199228 A1 * 8/2011 Roddy ..... E21B 47/01 340/856.4
2012/0256634 A1 10/2012 Morys
(Continued)

FOREIGN PATENT DOCUMENTS

EP 0329709 B1 7/1993

OTHER PUBLICATIONS

International Search Report and Written Opinion, PCT Application No. PCT/US2020/053126, dated Jan. 15, 2021.

*Primary Examiner* — Kristyn A Hall
(74) *Attorney, Agent, or Firm* — Polsinelli PC

(57) ABSTRACT

System and methods for detecting a composition in a wellbore during a cementing operation. An electrochemical cell can be disposed towards an end of a wellbore. The electrochemical cell can generate electrical energy in response to a physical presence of a composition at the electrochemical cell. The composition can be pumped from a surface of the wellbore during a cementing operation of the wellbore. Further, a telemetry signal indicating the physical presence of the composition at the electrochemical cell can be generated based on the electrical energy generated by the electrochemical cell. As follows, the telemetry signal can be transmitted to the surface of the wellbore.

17 Claims, 5 Drawing Sheets

(56) References Cited

U.S. PATENT DOCUMENTS

| | | | | |
|---|---|---|---|---|
| 2014/0002089 | A1* | 1/2014 | Wood | E21B 47/12 324/366 |
| 2015/0330214 | A1 | 11/2015 | Duphorne | |
| 2017/0002622 | A1 | 1/2017 | De Bruijn et al. | |
| 2017/0139076 | A1 | 5/2017 | Van Oort et al. | |
| 2017/0254191 | A1 | 9/2017 | Barfoot et al. | |
| 2018/0283165 | A1 | 10/2018 | Gao et al. | |

* cited by examiner

CEMENT AS A BATTERY FOR DETECTION DOWNHOLE

CROSS-REFERENCE TO RELATED APPLICATIONS

This application claims the benefit of U.S. Provisional Application No. 62/969,020, filed Feb. 1, 2020, which is incorporated herein by reference.

TECHNICAL FIELD

The present disclosure relates generally to systems and methods for detecting a composition in a wellbore during a cementing operation, and more specifically (although not necessarily exclusively), to systems and methods for detecting a location of cement pumped into a wellbore through an electrochemical cell disposed in the wellbore.

BACKGROUND

During completion of a wellbore, the annular space between the wellbore wall and a casing string (or casing) can be filled with cement. This process is referred to as "cementing" the wellbore. Detection of wellbore fluids during cementing operations is important for monitoring the progress of the cementing operations and ultimately controlling the cementing operations, e.g. based on the progress. However, it is difficult to accurately detect the presence and location of a composition pumped into a wellbore during a cementing operation. Specifically, detecting cement in a wellbore during a reverse cementing operation is particularly difficult.

DETAILED DESCRIPTION

Figure 1:
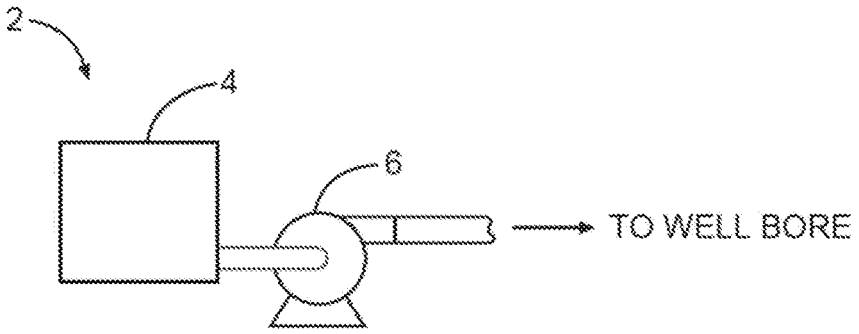
FIG. 1 illustrates a system for preparation and delivery of a cement composition to a well bore in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be apparent from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As used herein, "cement" is any kind of material capable of being pumped to flow to a desired location, and capable of setting into a solid mass at the desired location. "Cement slurry" designates the cement in its flowable state. In many cases, common calcium-silicate hydraulic cement is suitable, such as Portland cement. Calcium-silicate hydraulic cement includes a source of calcium oxide such as burnt limestone, a source of silicon dioxide such as burnt clay, and various amounts of additives such as sand, pozzolan, diatomaceous earth, iron pyrite, alumina, and calcium sulfate. In some cases, the cement may include polymer, resin, or latex, either as an additive or as the major constituent of the cement. The polymer may include polystyrene, ethylene/vinyl acetate copolymer, polymethylmethacrylate polyurethanes, polylactic acid, polyglycolic acid, polyvinylalcohol, polyvinylacetate, hydrolyzed ethylene/vinyl acetate, silicones, and combinations thereof. The cement may also include reinforcing fillers such as fiberglass, ceramic fiber, or polymer fiber. The cement may also include additives for improving or changing the properties of the cement, such as set accelerators, set retarders, defoamers, fluid loss agents, weighting materials, dispersants, density-reducing agents, formation conditioning agents, loss circulation materials, thixotropic agents, suspension aids, or combinations thereof.

The cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber-optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

As discussed previously, it is difficult to accurately detect the presence and location of a composition that is pumped into a wellbore during a cementing operation. Specifically, detecting cement, e.g. cement slurry, in a wellbore during a reverse cementing operation is particularly difficult.

The disclosed technology addresses the foregoing by providing methods and systems for detecting a composition in a wellbore during a cementing operation through an electrochemical cell disposed in the wellbore. More specifically, the disclosed technology addresses the foregoing by providing methods and systems for detecting the presence of cement slurry towards an end of a wellbore during a cementing operation through an electrochemical cell disposed towards the end of the wellbore.

In various embodiment, a method can include disposing an electrochemical cell towards an end of a wellbore. The electrochemical cell can generate electrical energy in response to a physical presence of a composition at the electrochemical cell. The composition can be pumped from a surface of the wellbore during a cementing operation of the wellbore. A telemetry signal indicating the physical presence of the composition at the electrochemical cell can be generated based on the electrical energy generated by the electrochemical cell. As follows, the telemetry signal can be transmitted to the surface of the wellbore. The telemetry signal can thus serve as an End of Job Indicator ("EOJI") to an operator or system at the surface.

In certain embodiments, a system can include an electrochemical cell disposed towards an end of a wellbore. The electrochemical cell can be configured to generate electrical energy in response to a physical presence of a composition at the electrochemical cell. The composition can be pumped from a surface of the wellbore during a cementing operation of the wellbore. The system can also include a signal generator electrically coupled to the electrochemical cell. The signal generator can be configured to generate a telemetry signal indicating the physical presence of the composition at the electrochemical cell based on the electrical energy generated by the electrochemical cell.

In various embodiments, a system can include a cement detection tool for disposal towards an end of a wellbore. The cement detection tool can include an electrochemical cell configured to generate electrical energy in response to a physical presence of a composition at the electrochemical cell. The composition can be pumped from a surface of the wellbore during a cementing operation of the wellbore. The cement detection tool can also include a signal generator electrically coupled to the electrochemical cell. The signal generator can be configured to generate a telemetry signal indicating the physical presence of the composition at the electrochemical cell based on the electrical energy generated by the electrochemical cell. The system can also include pumping equipment configured to pump the cement detection tool towards the end of the wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Referring now to FIG. 1, a system that may be used in cementing operations will now be described. FIG. 1 illustrates a system 2 for preparation of a cement composition and delivery to a well bore in accordance with certain embodiments. As shown, the cement composition may be mixed in mixing equipment 4, such as a jet mixer, recirculating mixer, or a batch mixer, for example, and then pumped via pumping equipment 6 to the well bore. In some embodiments, the mixing equipment 4 and the pumping equipment 6 may be disposed on one or more cement trucks as will be apparent to those of ordinary skill in the art. In some embodiments, a jet mixer may be used, for example, to continuously mix the composition, including water, as it is being pumped to the well bore.

Figure 2A:
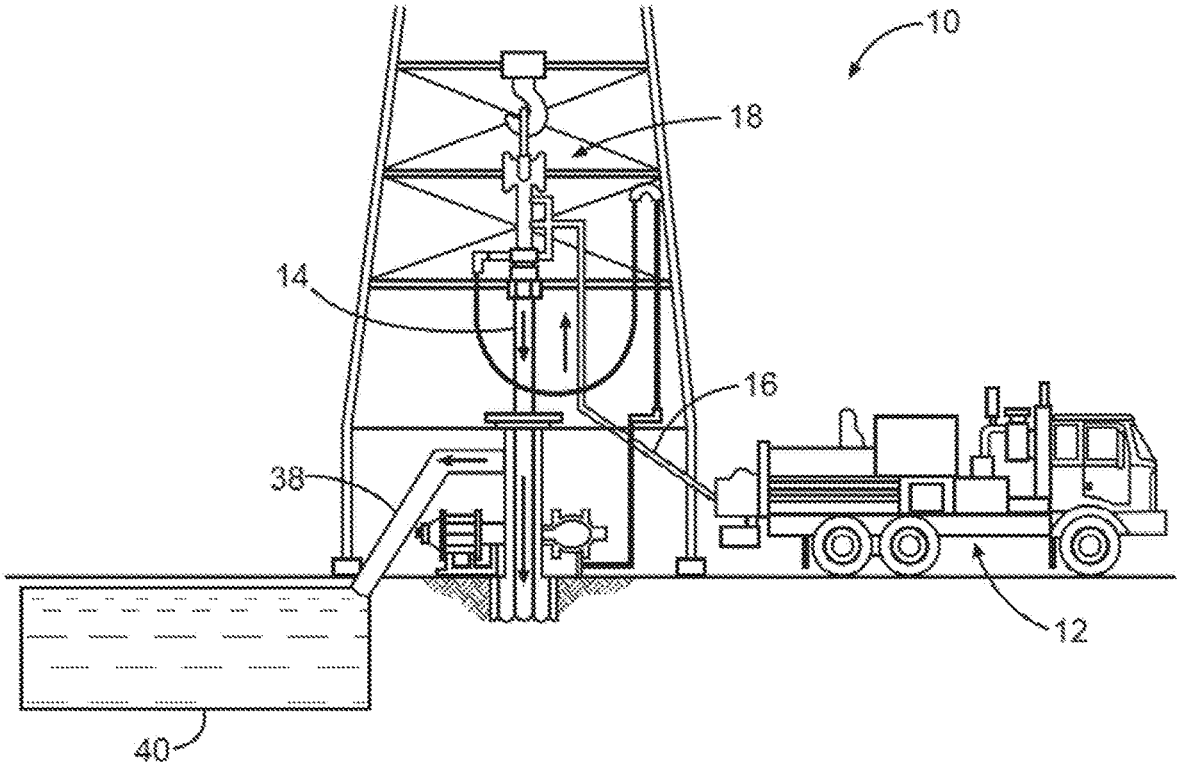
FIG. 2A illustrates surface equipment that may be used in placement of a cement composition in a well bore in accordance with aspects of the present disclosure.

An example technique and system for placing a cement composition into a subterranean formation will now be described with reference to FIGS. 2A and 2B. FIG. 2A illustrates surface equipment 10 that may be used in placement of a cement composition in accordance with certain embodiments. It should be noted that while FIG. 2A generally depicts a land-based operation, those skilled in the art will readily recognize that the principles described herein are equally applicable to subsea operations that employ floating or sea-based platforms and rigs, without departing from the scope of the disclosure. As illustrated by FIG. 2A, the surface equipment 10 may include a cementing unit 12, which may include one or more cement trucks. The cementing unit 12 may include mixing equipment 4 and pumping equipment 6 (e.g., FIG. 1) as will be apparent to those of ordinary skill in the art. The cementing unit 12 may pump a cement composition 14 through a feed pipe 16 and to a cementing head 18 which conveys the cement composition 14 downhole.

Figure 2B:
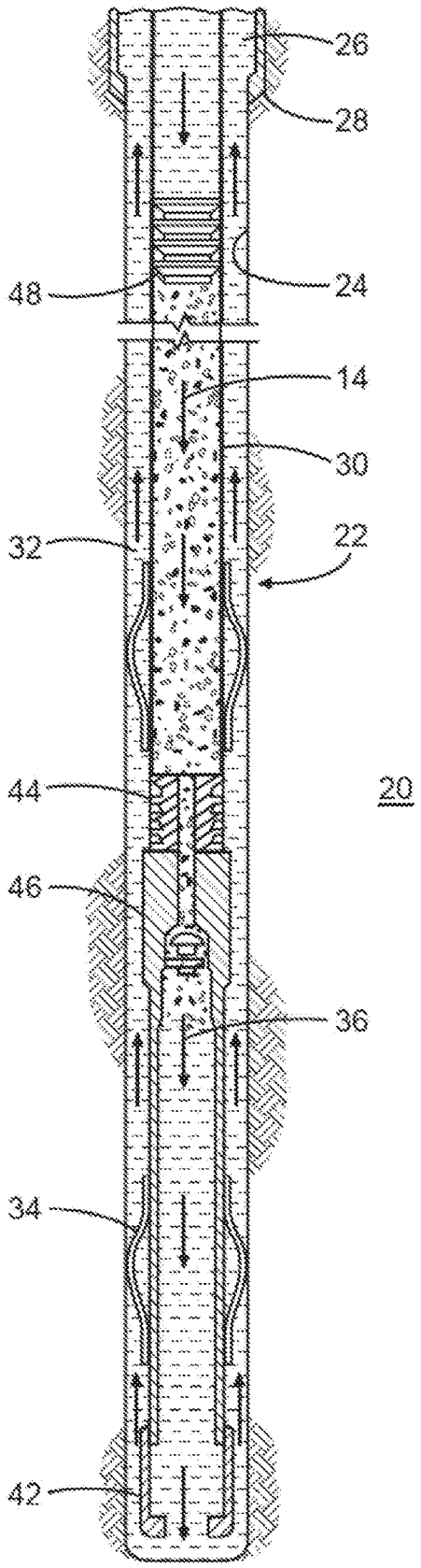
FIG. 2B illustrates placement of a cement composition into a well bore annulus in accordance with aspects of the present disclosure.

Turning now to FIG. 2B, the cement composition 14 may be placed into a subterranean formation 20 in accordance with example embodiments. As illustrated, a well bore 22 may be drilled into the subterranean formation 20. While well bore 22 is shown extending generally vertically into the subterranean formation 20, the principles described herein are also applicable to well bores that extend at an angle through the subterranean formation 20, such as horizontal and slanted well bores. As illustrated, the well bore 22 comprises walls 24. In the illustrated embodiments, a surface casing 26 has been inserted into the well bore 22. The surface casing 26 may be cemented to the walls 24 of the well bore 22 by cement sheath 28. In the illustrated embodiment, one or more additional conduits (e.g., intermediate casing, production casing, liners, etc.) shown here as casing 30 may also be disposed in the well bore 22. As illustrated, there is a well bore annulus 32 formed between the casing 30 and the walls 24 of the well bore 22 and/or the surface casing 26. One or more centralizers 34 may be attached to the casing 30, for example, to centralize the casing 30 in the well bore 22 prior to and during the cementing operation.

With continued reference to FIG. 2B, the cement composition 14 may be pumped down the interior of the casing 30. The cement composition 14 may be allowed to flow down the interior of the casing 30 through the casing shoe 42 at the bottom of the casing 30 and up around the casing 30 into the well bore annulus 32. The cement composition 14 may be allowed to set in the well bore annulus 32, for example, to form a cement sheath that supports and positions the casing 30 in the well bore 22.

As it is introduced, the cement composition 14 may displace other fluids 36, such as drilling fluids and/or spacer fluids, that may be present in the interior of the casing 30 and/or the well bore annulus 32. At least a portion of the displaced fluids 36 may exit the well bore annulus 32 via a flow line 38 and be deposited, for example, in one or more retention pits 40 (e.g., a mud pit), as shown on FIG. 2A.

Referring again to FIG. 2B, a bottom plug 44 may be introduced into the casing 30 ahead of the cement composition 14, for example, to separate the cement composition 14 from the fluids 36 that may be inside the casing 30 prior to cementing. After the bottom plug 44 reaches the landing collar 46, a diaphragm or other suitable device ruptures to allow the cement composition 14 through the bottom plug 44. In FIG. 2B, the bottom plug 44 is shown on the landing collar 46. In the illustrated embodiment, a top plug 48 may be introduced into the well bore 22 behind the cement composition 14. The top plug 48 may separate the cement composition 14 from a displacement fluid 53 and also push the cement composition 14 through the bottom plug 44.

While not illustrated, other techniques may also be utilized for introduction of the cement composition 14. By way of example, reverse circulation techniques, otherwise referred to as "reverse cementing" operations, may be used that include introducing the cement composition 14 into the subterranean formation 20 by way of the well bore annulus 32 instead of through the casing 30. An advantage of a reverse cementing technique is that pumping pressure can be substantially lower and the pumping pressure window can be smaller. However, a plug cannot be used in reverse cementing, necessitating different procedures for determining when the cement composition 14 has reached the bottom of the well bore 22.

Figure 3:
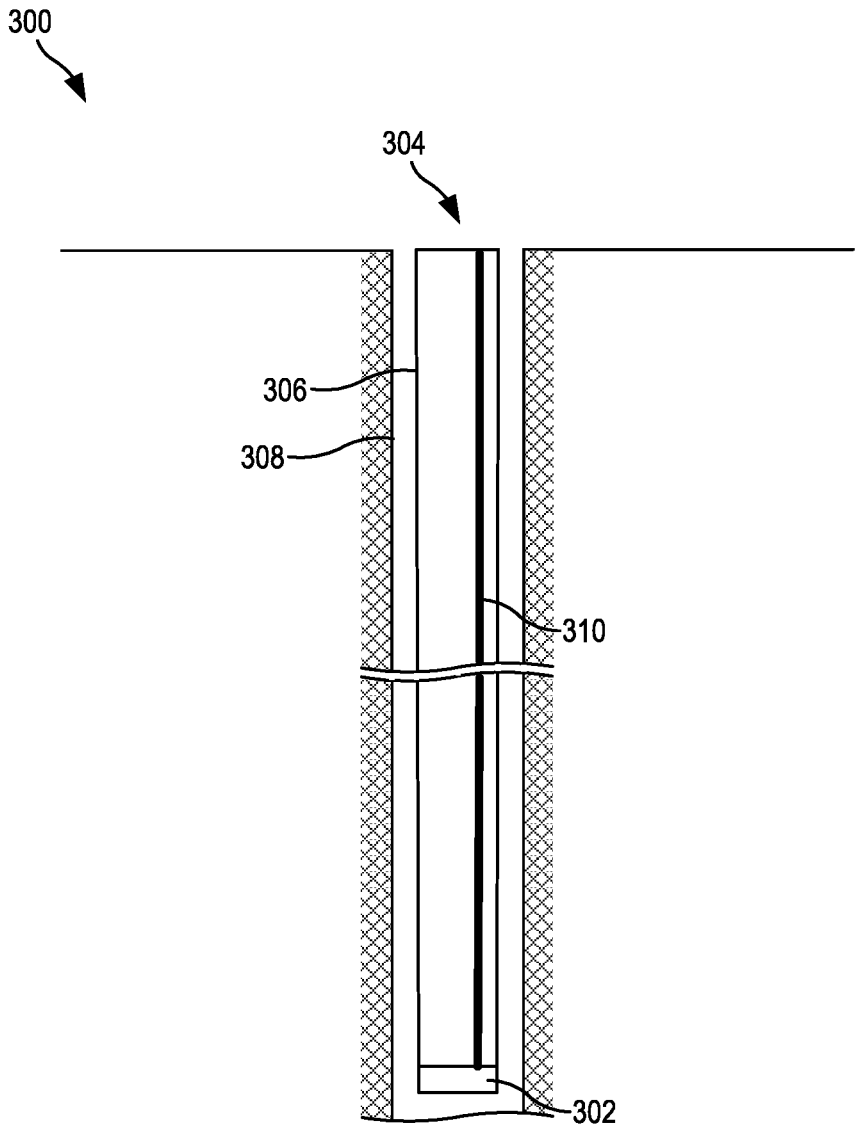
FIG. 3 is a schematic diagram of a wellbore environment with a disposed cement detection tool for detecting a composition pumped into a wellbore during a cementing operation in accordance with aspects of the present disclosure.

FIG. 3 is a schematic diagram of a wellbore environment 300 with a disposed cement detection tool 302 for detecting a composition pumped into a wellbore 304 during a cementing operation. The cement detection tool 302 can be disposed into the wellbore 304 by an applicable pumping system for pumping into a wellbore, such as the pumping equipment 6 shown in FIG. 1. The cement detection tool 302 can be disposed from the surface of the wellbore 304 towards the end of the wellbore 304 through an annulus formed between a casing 306 disposed in the wellbore 304 and a wall 308 of the wellbore 304. Alternatively, the cement detection tool 302 can be disposed from the surface of the wellbore 304 towards the end of the wellbore 304 through an interior of the casing 306. Further, the cement detection tool 302 can be disposed into the wellbore 304 as the casing 306 is disposed into the wellbore 304. Additionally, the cement detection tool 302 can be disposed into the wellbore 304 through a wireline technique.

The cement detection tool 302 is configured to detect a physical presence of a specific composition at the cement detection tool 302. In detecting a physical presence of a specific composition, the cement detection tool 302 can generate electrical energy when the specific composition is physically present at the cement detection tool 302. In turn, and as will be discussed in greater detail later, a telemetry signal indicating the physical presence of the specific composition at the cement detection tool 302 can be generated and transmitted to the surface of the wellbore 304. Specifically, a telemetry signal indicating the physical presence of the specific composition at the cement detection tool 302 can be generated from the electrical energy that is generated by the cement detection tool 302. As follows, the telemetry signal that is generated from the electrical energy can be transmitted to the surface of the wellbore 304.

Detecting a specific composition, as used herein with reference to the operation of the cement detection tool 302 and various components included as part of the cement detection tool 302, refers to detecting the physical presence of the specific composition at the cement detection tool 302. The cement detection tool 302 can detect a specific composition while the cement detection tool 302 is disposed in the wellbore 304 during a cementing operation. Specifically, the cement detection tool 302 can be disposed into the wellbore 304 before or during a cementing operation performed at the wellbore 304. As follows, the cement detection tool 302 can detect when a specific composition that is pumped during the cementing operation has reached the cement detection tool 302 disposed in the wellbore 304.

A composition detected by the cement detection tool 302 can include an applicable composition that is pumped into the wellbore 304 during a cementing operation. For example, the cement detection tool 302 can be configured to detect a cement slurry that is pumped into the wellbore 304 during a cementing operation. In another example, the cement detection tool 302 can be configured to detect a spacer that is pumped, e.g. before a cement slurry, during a cementing operation.

Further, a composition detected by the cement detection tool 302 can be pumped into the wellbore 304 through an applicable portion of the wellbore 304. For example, the cement detection tool 302 can detect a composition that is pumped from the surface through the annulus formed between the casing 306 and the wall 308 of the wellbore 304. In another example, the cement detection tool can detect a composition that is pumped from the surface through the interior of the casing 306 towards the end of the wellbore 304.

Detection of a specific composition by the cement detection tool 302 can be indicative of a physical location of a volume of cement slurry in the wellbore 304 during a cementing operation. Specifically, detection of a specific composition by the cement detection tool 302 can be indicative of a physical location of a volume of cement slurry in the wellbore 304 with respect to a position of the cement detection tool 302 during a cementing operation. For example, if cement slurry is detectable by the cement detection tool 302, then detection of the cement slurry can indicated that the volume of cement slurry is at a location of the cement detection tool 302. In another example, if a spacer is detectable by the cement detection tool 302, then detection of the spacer can indicate that a volume of cement slurry is behind the spacer and at the location of the cement detection tool 302 in the wellbore 304.

By detecting a specific composition that is indicative of a physical location of a volume of cement slurry in the wellbore 304, the cement detection tool 302 can effectively detect the physical location of the volume of cement slurry in the wellbore 304. As follows, the cement detection tool 302 can function to generate an EOJI for cementing operations. Specifically, the cement detection tool 302 can be positioned towards the end of the casing 306 and detect that a volume of cement slurry is at the end of the casing 306. In turn, the cement detection tool 302, as will be discussed in greater detail later, can generate a telemetry signal indicating that the cement slurry is at the end of the casing. As follows, the telemetry signal can be transmitted to the surface of the wellbore 304 to signal to either or both a system or an operator at the surface that the cementing operation should be ceased. This is particularly advantageous in reverse cementing operations, where it is difficult to detect when cement slurry has reached the end of the wellbore and started flowing through the interior of casing.

In the example wellbore environment 300 shown in FIG. 3, the cement detection tool 302 is positioned within the interior of the casing 306 towards the end of the wellbore 304. Specifically, the cement detection tool 302 can be integrated as part of a shoe disposed within the interior of the casing 306 towards the end of the wellbore 304. In various embodiments, the cement detection tool 302 can be positioned outside of the casing 306 towards the end of the wellbore 304. For example, the cement detection tool 302 can be positioned in the annulus formed between the casing 306 and the wall 308 of the wellbore 304 towards the end of the wellbore 304.

The cement detection tool 302 can be disposed in the wellbore 304 at an applicable position for detecting one or more compositions pumped during a cementing operation. Specifically, the cement detection tool 302 can be disposed in the wellbore 304 at a specific position for detecting a beginning of a cement slurry during a specific portion of a cementing operation. For example, the cement detection tool 302 can be disposed halfway down the annulus to detect when a cement slurry has passed halfway down the annulus.

The cement detection tool 302 can be positioned in the wellbore 304 based on a region of the wellbore 304 through which compositions are pumped into the wellbore 304 during a cementing operation. Specifically, the cement detection tool 302 can be positioned in the wellbore 304 based on whether compositions are pumped into the wellbore through the annulus formed between the casing 306 and the wall 308 of the wellbore 304 or the interior of the casing 306. For example, the cement detection tool 302 can be positioned in the wellbore 304 to detect cement slurry as it is pumped down through the annulus and flows from the annulus into the interior of the casing 306 at the bottom of the wellbore 304. In another example, the cement detection tool 302 can be positioned in the wellbore to detect cement slurry as it is pumped down through the interior of the casing 306 and flows from the interior of the casing 306 and into the annulus at the bottom of the wellbore 304. In yet another example, the cement detection tool 302 can be positioned in the wellbore 304 at the end of the casing to detect cement slurry as it flows from the annulus into the interior of the casing 306 and detect cement slurry as it flows from the interior of the casing 306 into the annulus.

The cement detection tool 302 can be specific to a composition. In being specific to a composition, the cement detection tool 302 can be designed and/or operated, e.g. based on characteristics of the composition, to distinctly detect the composition. In particular and as cement slurry has one of the highest pH levels of compositions pumped during a cementing operation, the cement detection tool 302 can be designed to generate a signal, e.g. by generating electrical energy, when exposed to the high pH levels of cement slurry. In another example, the cement detection tool 302 can be designed to specifically detect a spacer composition.

Figure 4:
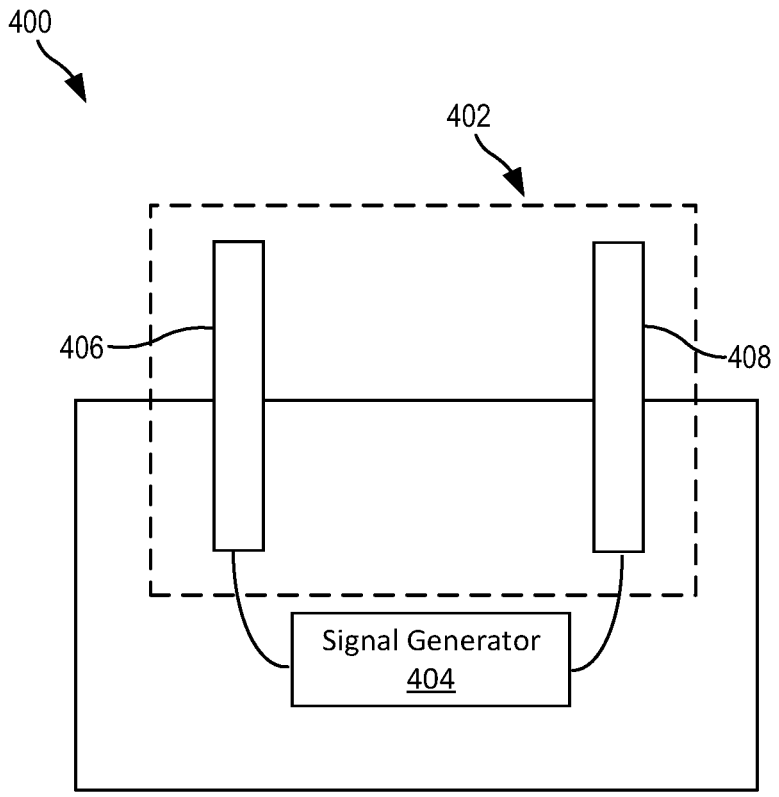
FIG. 4 is a schematic diagram of an example cement detection tool in accordance with aspects of the present disclosure.

FIG. 4 is a schematic diagram of an example cement detection tool 400. The cement detection tool 400 can be operated in an applicable wellbore environment, such as the wellbore environment 300 shown in FIG. 3. Further, the cement detection tool 400 can be operated in an applicable cementing operation to detect one or more compositions, e.g. cementing slurry, pumped during the cementing operation. For example, the cement detection tool 400 can be operated during a reverse cementing operation in a wellbore to detect a location of a volume of cement slurry, as the cement slurry is pumped through an annulus formed between a wellbore wall and casing.

The cement detection tool 400 includes an electrochemical cell 402 and a signal generator 404. The electrochemical cell 402 functions as a Galvanic cell to generate electrical energy, e.g. a current, in the physical presence one or more specific compositions. Specifically, the electrochemical cell 402 can function to generate electrical energy while in physical presence of one or more specific compositions pumped into a wellbore during a cementing operation. For example, the electrochemical cell 402 can generate electrical energy while in the physical presence of either or both a spacer composition and cement slurry pumped into a wellbore during a cementing operation. In generating electrical energy while in the physical presence of one or more specific compositions pumped into a wellbore during a cementing operation, the electrochemical cell 402 can effectively detect the presence of the one or more specific compositions during the cementing operation.

The signal generator 404 is electrically coupled to the electrochemical cell 402. In being electrically coupled to the electrochemical cell 402, the signal generator can generate a signal from the electrical energy generated by the electrochemical cell 402. This signal can serve as a telemetry signal that can be transmitted to the surface. Further, as the signal/telemetry signal can be generated from electrical energy generated by the electrochemical cell 402 in response to the presence of one or more specific compositions, the signal can serve as an indicator of the presence of the one or more specific compositions at the electrochemical cell 402. Specifically, the telemetry signal generated by the signal generator 404 can indicate a location of a volume of cement slurry, e.g. based on a position of the cement detection tool 400, in a wellbore environment during a cementing operation. More specifically, the telemetry signal can indicate when a volume of cement has reached the bottom of casing during a reverse cementing process and thereby serve as an EOJI for the reverse cementing process.

The signal generator 404 can be an applicable device for generating a signal that can be transmitted, e.g. towards a surface of a wellbore. Further, a telemetry signal generated by the signal generator 404 can be in an applicable form for transmission, e.g. towards a surface of a wellbore. For example, the signal generator 404 can be a light generating device, e.g. a light emitting diode, and the telemetry signal generated by the signal generator 404 can be an optical signal. In another example, the signal generator 404 can be a radio-frequency signal generator and the telemetry signal generated by the signal generator 404 can include one or more radio waves. In yet another example, the signal generator 404 can be an acoustic signal generator and the telemetry signal generated by the signal generator 404 can include one or more acoustic waves. In another example, the signal generator 404 can be a pressure generating device and the telemetry signal generated by the signal generator 404 can include a signal formed by varying pressure in one or more applicable mediums. In yet another example, the signal generator 404 be a temperature varying device and the telemetry signal generated by the signal generator 404 can include a signal formed by varying temperature in one or more applicable mediums.

The electrochemical cell 402 in the example cement detection tool 400 shown in FIG. 4 includes a first electrode 406 and a second electrode 408. The first electrode 406 and the second electrode 408 can be electrochemically dissimilar electrodes. More specifically, the first electrode 406 and the second electrode 408 can be formed by different materials, e.g. with different electrochemical characteristics. For example, the first electrode 406 can be comprised of copper while the second electrode 408 can be comprised of galvanized iron. As a result, an electrochemical potential, and a corresponding electrical current as part of generated electrical energy, can be generated between the first electrode 406 and the second electrode 408 in the presence of one or more compositions. More specifically, an electrochemical potential can be generated between the first electrode 406 and the second electrode 408 in the presence of one or more compositions pumped into a wellbore during a cementing operation.

The electrochemical cell 402 can be specific to one or more composition. In being specific to one or more compositions, the electrochemical cell 402 can generate electrical energy when the electrochemical cell 402 is exposed, at least in part, to the one or more compositions. For example, the electrochemical cell 402 can be specific to cement slurry and configured to generate electrical energy in the presence of cement slurry. Characteristics of either or both the first electrode 406 and the second electrode 408 can be selected based on one or more specific compositions that are detectable by the electrochemical cell 402. For example, the electrochemical cell 402 can be designed to detect cement slurry by fabricating the first electrode 406 and the second electrode 408 from materials for generating electrical energy in the presence of cement slurry.

It is possible that certain muds disposed within a wellbore will also be able to act as electrochemical cells along with the electrochemical cell 402. Specifically, seawater in a base fluid in drilling mud can serve, at least part of, an electrochemical cell. As a result, different compositions can have different electrochemical potentials and leading to variations in the amount and direction of current generated at the cement detection tool 400. Accordingly, the cement detection tool 400 can include components, e.g. capacitor(s), diode(s), and light emitting elements, that have variable responses as a function of an amount of current passing through the components.

Returning back to FIG. 3, the wellbore environment 300 includes a waveguide 310 between the cement detection tool 302 and the surface. The waveguide 310 is configured to transmit a telemetry signal generated by the cement detection tool 302 to the surface of the wellbore 304. In transmitting a telemetry signal from the cement detection tool 302 to the surface of the wellbore 304, the waveguide 310 can be coupled to the cement detection tool 302 according to an applicable transmission medium through which the telemetry signal is capable of being transmitted. For example, the waveguide 310 can be one or a combination of acoustically coupled, optically coupled, and electrically coupled to the cement detection tool 302 to transmit a telemetry signal to the surface of the wellbore 304. As follows, the waveguide 310 can have characteristics to facilitate transmission of the telemetry signal according to the transmission medium of the telemetry signal. For example, the waveguide 310 can be one or a combination of an optical waveguide, an acoustic waveguide, and a transmission line.

The waveguide 310 can be positioned at an applicable position in the wellbore 304 for transmitting telemetry signals generated by the cement detection tool 302. Further, the waveguide 310 can be disposed in the wellbore 304 through an applicable technique. For example, the waveguide 310 can be formed as part of permanently installed sensors in the wellbore 304. Specifically, the waveguide 310 can be formed through one or more fiber optic cables cemented in place during a cementing operation in the annular space between the casing 306 and wall of the wellbore 304. The fiber optic cables may be clamped to the outside of the casing during the deployment, and protected by centralizers and cross coupling clamps. The waveguide 310 can be formed with other types of permanent sensors, such as surface and down-hole pressure sensors, where the pressure sensors may be capable of collecting data at rates up to 2,000 Hz or even higher.

In various embodiments, telemetry signals can be relayed through the waveguide 310 to the surface in real-time. As follows, the telemetry signals can be used to modulate various operational parameters, such as flow rate, density of the fluids, and cement/spacer design during a cementing operation. Such modulation can be controlled by an operator at the surface, semi-autonomously through the operator at the surface, or autonomously at the surface.

The waveguide 310 can be implemented through one or more fiber-optic cables that can house one or more optical fibers. The optical fibers may be single mode fibers, multimode fibers, or a combination of single mode and multimode optical fibers. One or more Distributed Fiber-Optic Sensing (DFOS) systems may be connected to the optical fibers, including, without limitation, Distributed Temperature Sensing (DTS) systems, Distributed Acoustic Sensing (DAS) Systems, Distributed Strain Sensing (DSS) systems, quasi-distributed sensing systems where multiple single point sensors are distributed along an optical fiber/cable, or single point sensing systems where the sensors are located at the end of the one or more fiber-optic cables.

DTS systems, for example, are optoelectronic devices that measure temperatures by means of fiber-optic cables functioning as linear sensors. DTS systems transmit approximately 1 m laser pulses (equivalent to a 10 ns time) into the fiber-optic cable. As the pulse travels along the length of the fiber-optic cable, it interacts with the glass. Due to small imperfections in the glass, a tiny amount of the original laser pulse is reflected back to towards the DTS system. By analyzing the reflected light, the DTS system is able to calculate the temperature of the event (by analyzing the power of the reflected light) and also the location of the event (by measuring the time it takes the backscattered light to return). Temperatures are recorded along the fiber optic cable as a continuous profile. A high accuracy of temperature determination is achieved over great distances. Typically, the DTS systems can locate the temperature to a spatial resolution of 1 m with accuracy to within ±1° C. at a resolution of 0.01° C.

DAS systems use fiber-optic cables to provide distributed acoustic and/or strain sensing. In DAS, the fiber-optic cable becomes the sensing element and measurements are made, and in part processed, using an attached optoelectronic device. Such a system allows dynamic measurements caused by acoustic and/or strain signals impacting the optical fiber where frequency and/or amplitude signals can be detected over large distances and in harsh environments. Strain events can be due to mechanical strain and/or thermally induced strain in the optical fiber.

DFOS systems may operate using various sensing principles including but not limited to:

i. amplitude-based sensing systems, such as DTS systems based on Raman scattering, ii. phase-sensing-based systems or intensity-sensing-based systems, such as DAS systems based on interferometric sensing using, e.g., homodyne or heterodyne techniques, where the system may sense phase or intensity changes due to constructive or destructive interference, where interferometric signals may be used to detect interferometric signatures and/or processed into time series data and/or frequency/amplitude data and/or other frequency domain data for subsequent processing and filtering where the filtering/processing may generate interferometric signatures, iii. strain-sensing systems, such as DSS systems using dynamic strain measurements based on interferometric sensors or static strain sensing measurements using, e.g., Brillouin scattering, iv. quasi-distributed sensors based on, e.g., Fiber Bragg Gratings (FBGs) where a wavelength shift is detected or multiple FBGs are used to form Fabry-Perot type interferometric sensors for phase or intensity-based sensing, and/or v. single point fiber-optic sensors based on Fabry-Perot or FBG or intensity based sensors.

Electrical sensors may be pressure sensors based on quartz-type sensors or strain-gauge-based sensors or other commonly used sensing technologies. Pressure sensors, optical or electrical, may be housed in dedicated gauge mandrels or attached outside the casing in various configurations for down-hole deployment or deployed at the surface well head or flow lines.

Various hybrid approaches may be employed where single point or quasi-distributed or distributed fiber-optic sensors are mixed with, e.g., electrical sensors. The fiber-optic cable may then include optical fiber and electrical conductors.

Temperature measurements from, e.g., a DTS system, may be used to determine locations for fluid inflow in the treatment well as the fluids from the surface are likely to be cooler than formation temperatures. It is known in the industry to use DTS warm-back analyses to determine fluid volume placement and location, which is often done for water injection wells (the same technique can be used for fracturing fluid placement). Temperature measurements in observation wells can be used to determine fluid communication between the treatment well and observation well, or to determine formation fluid movement.

DAS data can be used to determine fluid allocation in real-time as acoustic noise is generated when fluid flows through the casing and in through perforations into the formation. Phase- and intensity-based interferometric sensing systems are sensitive to temperature and mechanical as well as acoustically induced vibrations. DAS data can be converted from time-series data to frequency-domain data using Fast Fourier Transforms (FFT), and other transforms like wavelet transforms may also be used to generate different representations of the data. Various frequency ranges can be used for different purposes and where, e.g., low frequency signal changes may be attributed to formation strain changes or fluid movement and other frequency ranges may be indicative of fluid or gas movement. Various fluids may be introduced to generate boundaries between different fluids such that fluid velocities can be tracked with the DAS system, or different fluids may have different noise profiles, or various materials may be introduced in the fluids as active acoustic noise makers for tracking purposes. DAS data can also be used for microseimic monitoring where small earth quakes (aka micro seismic events) can be triangulated.

Various filtering techniques may be applied to generate indicators of events than may be of interest. Indicators may include, without limitation, formation movement due to growing natural fractures, formation stress changes during the fracturing operations (i.e., stress shadowing), fluid seepage during the fracturing operation as formation movement may force fluid into an observation well, fluid flow from fractures, as well as fluid and proppant flow from frac hits.

DAS systems can also be used to detect various seismic events where stress fields and/or growing fracture networks generate microseimic events or where perforation charge events may be used to determine travel time between horizontal wells, and this information can be used from stage to stage to determine changes in travel time as the formation is fractured and filled with fluid and proppant. The DAS systems may also be used with surface seismic sources to generate vertical seismic profiles before, during and after a fracturing job to determine the effectiveness of the fracturing job as well as determine production effectiveness.

DSS data can be generated using various approaches and static strain data can be used to determine absolute strain changes over time. Static strain data is often measured using Brillouin-based systems or quasi-distributed strain data from FBG based system. Static strain may also be used to determine propped fracture volume by looking at deviations in strain data from a measured strain baseline before fracturing a stage. It may also be possible to determine formation properties like permeability, poroelastic responses and leak off rates based on the change of strain vs time and the rate at which the strain changes over time. Dynamic strain data can be used in real-time to detect fracture growth through an appropriate inversion model, and appropriate actions like dynamic changes to fluid flow rates in the treatment well, addition of diverters or chemicals into the fracturing fluid or changes to proppant concentrations or types can then be used to mitigate detrimental effects.

FBG-based systems may also be used for a number of different measurements. FBGs are partial reflectors that can be used as temperature and strain sensors, or can be used to make various interferometric sensors with very high sensitivity. FBGs can be used to make point sensors or quasi-distributed sensors where these FBG based sensors can be used independently or with other types of fiber-optic based sensors. FBGs can manufactured into an optical fiber at a specific wavelength, and other system like DAS, DSS or DTS systems may operate at different wavelengths in the same fiber and measure different parameters simultaneously as the FBG-based systems using Wavelength Division Multiplexing (WDM).

The sensors can be placed in either the treatment well or monitoring well(s) to measure well communication. The treatment well pressure, rate, proppant concentration, diverters, fluids and chemicals may be altered to change the hydraulic fracturing treatment. These changes may impact the formation responses in several different ways, including:

i. stress fields may change, and this may generate microseismic effects that can be measured with DAS systems and/or single point seismic sensors like geophones, ii. fracture growth rates may change and this can generate changes in measured microseismic events and event distributions over time, or changes in measured strain using the low frequency portion or the DAS signal or Brillouin based sensing systems, iii. pressure changes due to poroelastic effects may be measured in the monitoring well, iv. pressure data may be measured in the treatment well and correlated to formation responses, and/or v. various changes in treatment rates and pressure may generate events that can be correlated to fracture growth rates.

One or more applicable measurements made during a cementing operation can be analyzed in detecting, at the surface, a location of a volume of cement slurry during a cementing operation. Accordingly, one or more applicable measurements made during a cementing operation can be analyzed in identifying or verifying an EOJI at the surface for the cementing operation. Such measurements can include a telemetry signal received from the cement detection tool 302, DTS measurements, DAS measurements, DSS measurements, and surface measurements. For example, DAS systems and DTS systems can track the movement of cement slurry as it is pumped through the wellbore. In turn, measurements from such systems can be applied to verify a telemetry signal received from the cement detection tool 302 that indicates the cement slurry has reached the cement detection tool 302. In another example, bottom hole pressure and surface pressure measurements can be applied to verify a telemetry signal received from the cement detection tool 302 that indicates the cement slurry has reached the cement detection tool 302.

Figure 5:
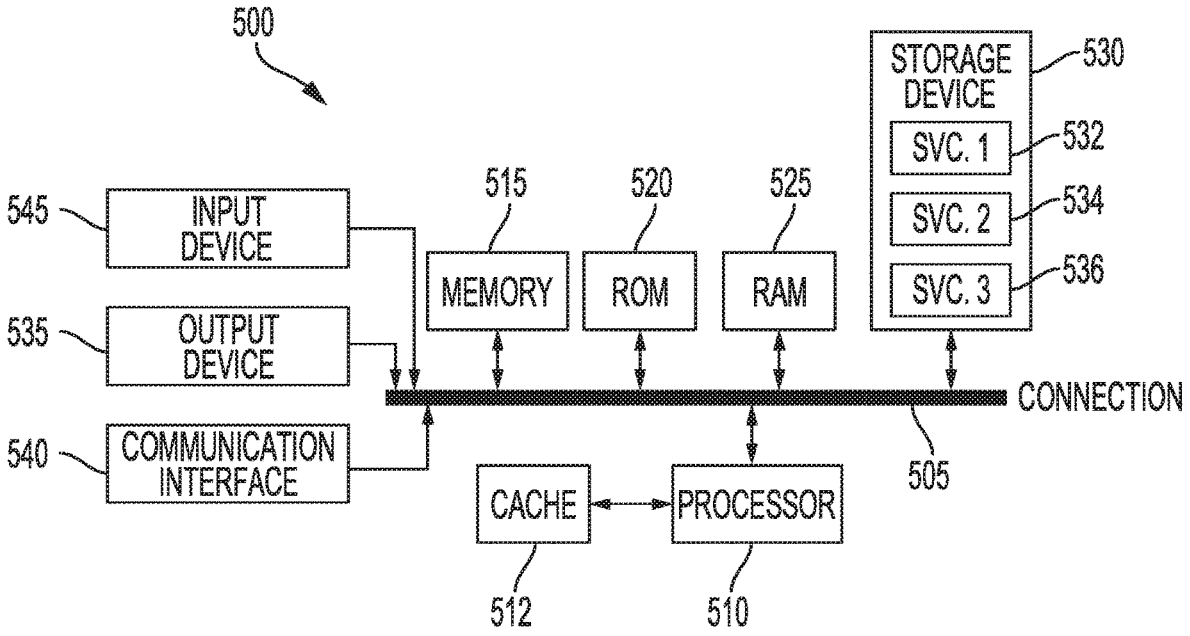
FIG. 5 illustrates an example computing device architecture in accordance with aspects of the present disclosure.

FIG. 5 illustrates an example computing device architecture 500 which can be employed to perform various steps, methods, and techniques disclosed herein. Specifically, the techniques described herein can be implemented, at least in part, through the computing device architecture 500 in an applicable cement detection tool, such as the cement detection tool 302, in an applicable wellbore environment, such as the wellbore environment 300, during a cementing operation. The various implementations will be apparent to those of ordinary skill in the art when practicing the present technology. Persons of ordinary skill in the art will also readily appreciate that other system implementations or examples are possible.

As noted above, FIG. 5 illustrates an example computing device architecture 500 of a computing device which can implement the various technologies and techniques described herein. The components of the computing device architecture 500 are shown in electrical communication with each other using a connection 505, such as a bus. The example computing device architecture 500 includes a processing unit (CPU or processor) 510 and a computing device connection 505 that couples various computing device components including the computing device memory 515, such as read only memory (ROM) 520 and random access memory (RAM) 525, to the processor 510.

The computing device architecture 500 can include a cache of high-speed memory connected directly with, in close proximity to, or integrated as part of the processor 510. The computing device architecture 500 can copy data from the memory 515 and/or the storage device 530 to the cache 512 for quick access by the processor 510. In this way, the cache can provide a performance boost that avoids processor 510 delays while waiting for data. These and other modules can control or be configured to control the processor 510 to perform various actions. Other computing device memory 515 may be available for use as well. The memory 515 can include multiple different types of memory with different performance characteristics. The processor 510 can include any general purpose processor and a hardware or software service, such as service 1 532, service 2 534, and service 3 536 stored in storage device 530, configured to control the processor 510 as well as a special-purpose processor where software instructions are incorporated into the processor design. The processor 510 may be a self-contained system, containing multiple cores or processors, a bus, memory controller, cache, etc. A multi-core processor may be symmetric or asymmetric.

To enable user interaction with the computing device architecture 500, an input device 545 can represent any number of input mechanisms, such as a microphone for speech, a touch-sensitive screen for gesture or graphical input, keyboard, mouse, motion input, speech and so forth. An output device 535 can also be one or more of a number of output mechanisms known to those of skill in the art, such as a display, projector, television, speaker device, etc. In some instances, multimodal computing devices can enable a user to provide multiple types of input to communicate with the computing device architecture 500. The communications interface 540 can generally govern and manage the user input and computing device output. There is no restriction on operating on any particular hardware arrangement and therefore the basic features here may easily be substituted for improved hardware or firmware arrangements as they are developed.

Storage device 530 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 525, read only memory (ROM) 520, and hybrids thereof. The storage device 530 can include services 532, 534, 536 for controlling the processor 510. Other hardware or software modules are contemplated. The storage device 530 can be connected to the computing device connection 505. In one aspect, a hardware module that performs a particular function can include the software component stored in a computer-readable medium in connection with the necessary hardware components, such as the processor 510, connection 505, output device 535, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. A method comprising: disposing an electrochemical cell towards an end of a wellbore; generating, by the electrochemical cell, electrical energy in response to a physical presence of a composition at the electrochemical cell, wherein the composition is pumped from a surface of the wellbore during a cementing operation of the wellbore; generating a telemetry signal indicating the physical presence of the composition at the electrochemical cell based on the electrical energy generated by the electrochemical cell; and transmitting the telemetry signal to the surface of the wellbore.

Statement 2. The method of statement 1, wherein the electrical energy is generated in response to the physical presence of the composition at the electrochemical cell during the cementing operation of the wellbore.

Statement 3. The method of statements 1-2, wherein the composition is cement slurry that is pumped during the cementing operation.

Statement 4. The method of statements 1-3, wherein the composition is a spacer pumped during the cementing operation.

Statement 5. The method of statements 1-4, wherein the electrochemical cell is specific to the composition and configured to detect the physical presence of the composition at the electrochemical cell.

Statement 6. The method of statements 1-5, wherein the electrochemical cell includes a first electrode with first electrode characteristics selected based on one or more properties of the composition and a second electrode with second electrode characteristics selected based on the one or more properties of the composition and the first electrode characteristics are electrically dissimilar from the second electrode characteristics.

Statement 7. The method of statements 1-6, wherein the first electrode characteristics and the second electrode characteristics are selected to generate an electrical current between the first electrode and the second electrode in the physical presence of the composition at the electrochemical cell.

Statement 8. The method of statements 1-7, wherein the physical presence of the composition at the electrochemical cell is indicative of a physical location in the wellbore of a volume of cement slurry pumped during the cementing operation.

Statement 9. The method of statements 1-8, wherein the volume of cement slurry is pumped from the surface through an interior of a casing disposed in the wellbore.

Statement 10. The method of statements 1-9, wherein the electrochemical cell is disposed at a specific position towards the end of the wellbore such that the physical location of the volume of cement slurry indicated by the physical presence of the composition at the electrochemical cell is a location in the wellbore where the volume of cement slurry passes from the interior of the casing to an annulus formed between the casing and a wall of the wellbore.

Statement 11. The method of statements 1-10, wherein the volume of cement slurry is pumped from the surface through an annulus formed between a casing disposed in the wellbore and a wall of the wellbore.

Statement 12. The method of statements 1-11, wherein the electrochemical cell is disposed at a specific position towards the end of the wellbore such that the physical location of the volume of cement slurry indicated by the physical presence of the composition at the electrochemical cell is a location in the wellbore where the volume of cement slurry passes from the annulus to an interior of the casing.

Statement 13. The method of statements 1-12, wherein the telemetry signal is transmitted towards the surface through a waveguide disposed in the wellbore.

Statement 14. The method of statements 1-13, wherein the telemetry signal is an optical signal and the waveguide is an optical waveguide.

Statement 15. The method of statements 1-14, wherein the optical signal is generated by a light source electrically coupled to the electrochemical cell and configured to generate the optical signal using the electrical energy generated by the electrochemical cell in response to the physical presence of the composition at the electrochemical cell.

Statement 16. A system comprising: an electrochemical cell disposed towards an end of a wellbore and configured to generate electrical energy in response to a physical presence of a composition at the electrochemical cell, wherein the composition is pumped from a surface of the wellbore during a cementing operation of the wellbore; and a signal generator electrically coupled to the electrochemical cell and configured to generate a telemetry signal indicating the physical presence of the composition at the electrochemical cell based on the electrical energy generated by the electrochemical cell.

Statement 17. The system of statement 16, further comprising a waveguide coupled to the signal generator and configured to transmit the telemetry signal to the surface of the wellbore. Statement 18. The method of statements 15-17, generating a notification in response to monitoring one or more unexpected temperatures based on one or more of a geothermal profile and a design schematic for the wellbore.

Statement 18. A system comprising: a cement detection tool for disposal towards an end of a wellbore comprising: an electrochemical cell configured to generate electrical energy in response to a physical presence of a composition at the electrochemical cell, wherein the composition is pumped from a surface of the wellbore during a cementing operation of the wellbore; a signal generator electrically coupled to the electrochemical cell and configured to generate a telemetry signal indicating the physical presence of the composition at the electrochemical cell based on the electrical energy generated by the electrochemical cell; and pumping equipment configured to pump the cement detection tool towards the end of the wellbore.

Statement 19. The system of statement 18, wherein the pumping equipment is configured to pump the cement detection tool from the surface towards the end of the wellbore through an annulus formed between a casing disposed in the wellbore and a wall of the wellbore.

Statement 20. The system of statements 18-19, wherein the pumping equipment is configured to pump the cement detection tool from the surface towards the end of the wellbore through an interior of a casing disposed in the wellbore.

What is claimed is:

1. A method comprising:

disposing an electrochemical cell towards an end of a wellbore;

generating, by the electrochemical cell, electrical energy in response to a physical presence of a composition at the electrochemical cell, wherein the composition is pumped from a surface of the wellbore during a cementing operation of the wellbore;

generating a telemetry signal indicating the physical presence of the composition at the electrochemical cell based on the electrical energy generated by the electrochemical cell; and transmitting the telemetry signal to the surface of the wellbore;

wherein the telemetry signal is transmitted towards the surface through a waveguide disposed in the wellbore;

wherein the telemetry signal is an optical signal and the waveguide is an optical waveguide; and wherein the optical signal is generated by a light source electrically coupled to the electrochemical cell and configured to generate the optical signal using the electrical energy generated by the electrochemical cell in response to the physical presence of the composition at the electrochemical cell.

2. The method of claim 1, wherein the electrical energy is generated in response to the physical presence of the composition at the electrochemical cell during the cementing operation of the wellbore.

3. The method of claim 1, wherein the composition is cement slurry that is pumped during the cementing operation.

4. The method of claim 1, wherein the composition is a spacer pumped during the cementing operation.

5. The method of claim 1, wherein the electrochemical cell is specific to the composition and configured to detect the physical presence of the composition at the electrochemical cell.

6. The method of claim 5, wherein the electrochemical cell includes a first electrode with first electrode characteristics selected based on one or more properties of the composition and a second electrode with second electrode characteristics selected based on the one or more properties of the composition and the first electrode characteristics are electrically dissimilar from the second electrode characteristics.

7. The method of claim 6, wherein the first electrode characteristics and the second electrode characteristics are selected to generate an electrical current between the first electrode and the second electrode in the physical presence of the composition at the electrochemical cell.

8. The method of claim 1, wherein the physical presence of the composition at the electrochemical cell is indicative of a physical location in the wellbore of a volume of cement slurry pumped during the cementing operation.

9. The method of claim 8, wherein the volume of cement slurry is pumped from the surface through an interior of a casing disposed in the wellbore.

10. The method of claim 9, wherein the electrochemical cell is disposed at a specific position towards the end of the wellbore such that the physical location of the volume of cement slurry indicated by the physical presence of the composition at the electrochemical cell is a location in the wellbore where the volume of cement slurry passes from the interior of the casing to an annulus formed between the casing and a wall of the wellbore.

11. The method of claim 8, wherein the volume of cement slurry is pumped from the surface through an annulus formed between a casing disposed in the wellbore and a wall of the wellbore.

12. The method of claim 11, wherein the electrochemical cell is disposed at a specific position towards the end of the wellbore such that the physical location of the volume of cement slurry indicated by the physical presence of the composition at the electrochemical cell is a location in the wellbore where the volume of cement slurry passes from the annulus to an interior of the casing.

13. A system comprising:

an electrochemical cell disposed towards an end of a wellbore and configured to generate electrical energy in response to a physical presence of a composition at the electrochemical cell, wherein the composition is pumped from a surface of the wellbore during a cementing operation of the wellbore; and a signal generator electrically coupled to the electrochemical cell and configured to generate a telemetry signal indicating the physical presence of the composition at the electrochemical cell based on the electrical energy generated by the electrochemical cell;

wherein the telemetry signal is transmitted towards the surface through a waveguide disposed in the wellbore;

wherein the telemetry signal is an optical signal and the waveguide is an optical waveguide; and wherein the optical signal is generated by a light source electrically coupled to the electrochemical cell and configured to generate the optical signal using the electrical energy generated by the electrochemical cell in response to the physical presence of the composition at the electrochemical cell.

14. The system of claim 13, further comprising a waveguide coupled to the signal generator and configured to transmit the telemetry signal to the surface of the wellbore.

15. A system comprising:

a cement detection tool for disposal towards an end of a wellbore comprising:

an electrochemical cell configured to generate electrical energy in response to a physical presence of a composition at the electrochemical cell, wherein the composition is pumped from a surface of the wellbore during a cementing operation of the wellbore;

a signal generator electrically coupled to the electrochemical cell and configured to generate a telemetry signal indicating the physical presence of the composition at the electrochemical cell based on the electrical energy generated by the electrochemical cell; and pumping equipment configured to pump the cement detection tool towards the end of the wellbore;

wherein the telemetry signal is transmitted towards the surface through a waveguide disposed in the wellbore;

wherein the telemetry signal is an optical signal and the waveguide is an optical waveguide; and wherein the optical signal is generated by a light source electrically coupled to the electrochemical cell and configured to generate the optical signal using the electrical energy generated by the electrochemical cell in response to the physical presence of the composition at the electrochemical cell.

16. The system of claim 15, wherein the pumping equipment is configured to pump the cement detection tool from the surface towards the end of the wellbore through an annulus formed between a casing disposed in the wellbore and a wall of the wellbore.

17. The system of claim 15, wherein the pumping equipment is configured to pump the cement detection tool from the surface towards the end of the wellbore through an interior of a casing disposed in the wellbore.

* * * * *